US009788608B2

(12) United States Patent
Berend et al.

(10) Patent No.: US 9,788,608 B2
(45) Date of Patent: Oct. 17, 2017

(54) SHOE UPPER HAVING MULTIPLE WELD ZONES

(71) Applicant: Nike, Inc., Beaverton, OR (US)

(72) Inventors: Thomas Berend, Beaverton, OR (US); Douglas A. Beye, Beaverton, OR (US); Tony H. Le, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 360 days.

(21) Appl. No.: 13/766,065

(22) Filed: Feb. 13, 2013

(65) Prior Publication Data

US 2014/0223768 A1 Aug. 14, 2014

(51) Int. Cl.
*A43B 23/02* (2006.01)
*A43C 1/00* (2006.01)

(52) U.S. Cl.
CPC ..... *A43B 23/0245* (2013.01); *A43B 23/0235* (2013.01); *A43B 23/0255* (2013.01); *A43B 23/0275* (2013.01); *A43C 1/00* (2013.01)

(58) Field of Classification Search
CPC ... A43B 23/0235; A43B 1/04; A43B 23/0245; A43B 23/0255; A43B 23/026; A43B 23/025; A43B 23/0225; A43B 23/024; A43B 23/0265; A43B 23/0275; A43B 3/0078; A43B 23/0205; A43B 23/027; A43B 23/0215; A43B 1/0027; A43B 23/042; A43B 23/028
USPC ..... 36/45, 3, 102, 5
See application file for complete search history.

(56) References Cited

U.S. PATENT DOCUMENTS

| | | | | |
|---|---|---|---|---|
| 2,994,322 | A * | 8/1961 | Cullen et al. | 602/27 |
| 4,447,967 | A | 5/1984 | Zaino | |
| 5,713,399 | A | 2/1998 | Collette et al. | |
| 5,783,008 | A | 7/1998 | Belke, Jr. et al. | |
| 5,785,806 | A | 7/1998 | Engle et al. | |
| 5,894,983 | A | 4/1999 | Beck et al. | |
| 5,944,924 | A | 8/1999 | Engle et al. | |
| 6,382,494 | B1 | 5/2002 | Miller | |
| 6,450,393 | B1 | 9/2002 | Doumanidis et al. | |
| 6,519,500 | B1 | 2/2003 | White | |
| 6,520,399 | B1 | 2/2003 | Salzer et al. | |
| 6,578,753 | B1 | 6/2003 | Sakakura | |
| 6,835,257 | B2 | 12/2004 | Perrine | |
| 6,910,288 | B2 * | 6/2005 | Dua | 36/45 |
| 7,325,385 | B2 | 2/2008 | Nagashima et al. | |
| 7,424,783 | B2 | 9/2008 | Meschter et al. | |

(Continued)

FOREIGN PATENT DOCUMENTS

| | | |
|---|---|---|
| CN | 101774077 | 7/2010 |
| CN | 201913809 | 8/2011 |

(Continued)

OTHER PUBLICATIONS

International Search Report and Written Opinion mailed May 16, 2014 in International Application No. PCT/US2014/015903.

(Continued)

*Primary Examiner* — Alissa L Hoey
*Assistant Examiner* — Catherine M Ferreira
(74) *Attorney, Agent, or Firm* — Banner & Witcoff, Ltd.

(57) ABSTRACT

A shoe having a shoe upper including multiple welds in selected locations on the shoe upper. The welds may be selectively located on the upper to provide structure and support to the specific portions of a shoe upper.

20 Claims, 12 Drawing Sheets

(56) References Cited

U.S. PATENT DOCUMENTS

| | | | | |
|---|---|---|---|---|
| 7,493,191 | B1 | 2/2009 | Miller | |
| 7,776,171 | B2 | 8/2010 | Lehto et al. | |
| 7,824,513 | B2 | 11/2010 | Chernyak et al. | |
| 7,883,594 | B2 | 2/2011 | Albanese et al. | |
| 7,952,785 | B2 | 5/2011 | Karmhag et al. | |
| 8,800,172 | B2 * | 8/2014 | Dua et al. | 36/50.1 |
| 8,844,167 | B2 * | 9/2014 | Greene | 36/45 |
| 2003/0148076 | A1 * | 8/2003 | Huang | 428/196 |
| 2006/0048413 | A1 | 3/2006 | Sokolowski et al. | |
| 2006/0189236 | A1 | 8/2006 | Davis et al. | |
| 2007/0022627 | A1 * | 2/2007 | Sokolowski et al. | 36/3 A |
| 2007/0270969 | A1 | 11/2007 | Schmid | |
| 2007/0295440 | A1 | 12/2007 | Stucker et al. | |
| 2008/0028640 | A1 | 2/2008 | Lacorazza | |
| 2010/0018075 | A1 * | 1/2010 | Meschter et al. | 36/45 |
| 2010/0037483 | A1 | 2/2010 | Meschter et al. | |
| 2010/0251564 | A1 * | 10/2010 | Meschter | A43B 23/0225 36/28 |
| 2010/0263236 | A1 | 10/2010 | Carboy et al. | |
| 2011/0088282 | A1 * | 4/2011 | Dojan et al. | 36/45 |
| 2012/0023778 | A1 * | 2/2012 | Dojan et al. | 36/58.5 |
| 2012/0124866 | A1 | 5/2012 | Moriyasu et al. | |
| 2014/0173938 | A1 * | 6/2014 | Beye et al. | 36/102 |

FOREIGN PATENT DOCUMENTS

| | | | | |
|---|---|---|---|---|
| CN | 102548442 A | | 7/2012 | |
| DE | 102010017665 | | 1/2012 | |
| EP | 0965549 | | 12/1992 | |
| EP | 1495690 A1 | | 1/2005 | |
| IT | EP 1495690 | * | 3/2004 | A43B 23/07 |
| JP | 10229620 | | 8/1998 | |
| JP | 2006304862 | | 11/2006 | |
| WO | 9118527 | | 12/1991 | |

OTHER PUBLICATIONS

International Search Report and Written Opinion mailed May 16, 2014 in International Application No. PCT/US2014/015904.

International Preliminary Report on Patentability (including Written Opinion of the ISA) dated Aug. 18, 2015 in International Application No. PCT/US2014/015904.

International Preliminary Report on Patentability (including Written Opinion of the ISA) dated Aug. 18, 2015 in International Application No. PCT/US2014/015903.

Non-Final Office Action mailed Sep. 3, 2015 in U.S. Appl. No. 13/766,081.

Interview Summary mailed Oct. 15, 2015 in U.S. Appl. No. 13/766,081.

Office Action Response filed Oct. 16, 2015 in U.S. Appl. No. 13/766,081.

Notice of Allowance mailed Oct. 29, 2015 in U.S. Appl. No. 13/766,081.

Chinese Office Action dated Apr. 29, 2016 in Chinese Patent Application No. 201480008258.4.

Response to Chinese Office Action filed Sep. 8, 2016 in Chinese Patent Application No. 201480008258.4.

* cited by examiner

SHOE UPPER HAVING MULTIPLE WELD ZONES

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. Further over lapping pieces of material may impart stability and structure to specific parts of the shoe.

As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

The present disclosure relates generally to a shoe upper having multiple welds in selected locations on the shoe upper. The welds may be selectively located on the upper to provide structure and support to the selected locations.

In one aspect, the disclosure provides a shoe upper that may include a base material having a lateral side having multiple weld zones, multiple unwelded zones, and multiple eyelet portions overlaid on the base material, and a medial side having multiple weld zones, multiple unwelded zones, multiple eyelet portions overlaid on the base material. The shoe upper may further include a toe strap and an ankle strap In another aspect, the disclosure provides shoe that may include an upper having a base material. The upper further may include a lateral side of the upper comprises multiple weld zones, multiple unwelded zones, and multiple eyelet portions overlaid on the base material. Further, the upper may include a medial having multiple weld zones, multiple unwelded zones, multiple eyelet portions overlaid on the base material, a toe strap, and an ankle strap. The shoe may further include a sole structure.

In one aspect, the disclosure provides shoe that may include an upper having a base material. The upper further may include a lateral side of the upper comprises multiple weld zones having multiple welds and multiple unwelded zones. Further, the upper may include a medial having multiple weld zones having multiple welds and multiple unwelded zones. The shoe may further include a sole structure.

In another aspect, the disclosure provides a shoe having an upper that may include multiple welds in selected locations. The upper may further include additional material or strapping in selected locations on the medial side of the shoe upper. Further, the shoe upper may have welds in selected locations on the lateral side of the shoe upper opposite the strapping on the medial side of the upper. The welds on the lateral side of the upper may provide the same support and structure the additional material or strapping provides on the medial side of the upper.

In still another aspect, the disclosure provides a shoe upper that utilizes multiple welds in selected locations on the upper to provide structure and support to the shoe upper. The welds may be located on both medial and lateral sides of the shoe upper. The selective welds may replace the additional material or strapping that would typically provide the necessary structure and support to the selected locations on the upper.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
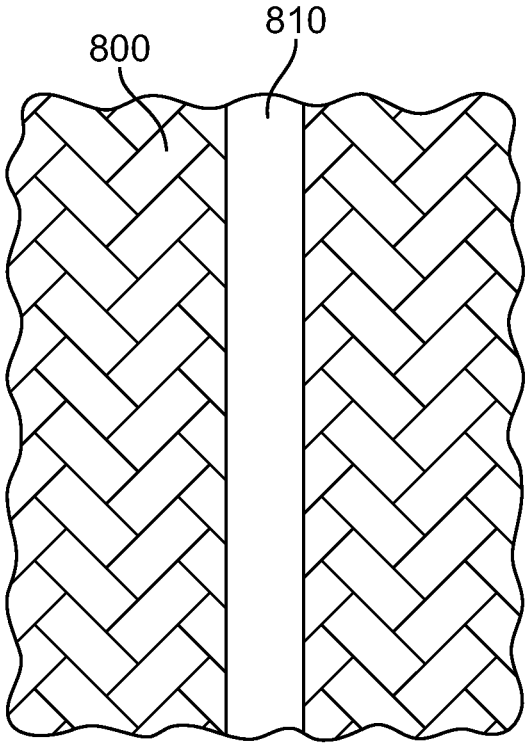
FIG. 1 is a schematic diagram of an embodiment of woven material that includes a welded portion.

The shoe upper of this disclosure may be configured for use in a wide range of athletic footwear styles, including running shoes, basketball shoes, cross-training shoes, football shoes, golf shoes, hiking shoes and boots, ski and snowboarding boots, soccer shoes, tennis shoes, and walking shoes, for example. Concepts associated with the shoe upper having multiple welds in selected areas may also be utilized with footwear styles that are generally considered to be primarily non-athletic, including dress shoes, loafers, sandals, casual shoes, clogs, flats, heels, pumps, wedges, and work boots.

In addition to footwear, the concept of welding material to provide support and structure as well as to form unwelded flex zones may be incorporated into other types of apparel and athletic equipment, including helmets, gloves, and protective padding for sports, such as football and hockey. Similar material may also be incorporated into cushions and other compressible structures utilized in household goods and industrial products.

Additionally, the discussion and figures disclose various configurations of a shoe upper as a portion of a shoe. Although the concepts shown on the shoe upper are disclosed as being incorporated into footwear, the concept of welding material to provide support and structure may be utilized with a variety of other products or for a variety of other purposes.

For purposes of this disclosure, the terms "shoe upper" and "upper" may be used interchangeably. The shoe upper or upper may include all portions of the shoe, excluding the laces and the sole structure.

As mentioned, portions of the shoe upper may be fused or welded. In some embodiments, the individual fibers, filaments, strands or layers that compose the base material of the upper may be fused or welded. For example, in FIG. 1, base material 800 may include one or more welds, such as first weld 810. In addition, in FIG. 5, base material 112 of upper 114 may include first 121 and second weld 123. In the figures, the welds formed in the upper are depicted as solid lines.

The base material of the upper may be formed from any suitable material for a shoe upper. The base materials may be a woven or non-woven material. The base material may be suitable for the fusing method utilized to form the welds in the base material.

In some embodiments, the base material may be a single layer of material. In other embodiments, the base material may be two or more layers. When the base material is multiple layers, each layer may be made of the same material or combination of materials. In other embodiments, each layer of the base material may be made of different suitable materials or combination of materials. Again, the materials used for the one or more layers of the base material of the upper may be suitable for the fusion method chosen to form the welds in the base material.

As mentioned above, in some embodiments, base material 800 in FIG. 1 may be a single layer. FIG. 1 depicts the base material of an upper as a woven fabric. Woven fabric 800 may be formed from any of the suitable materials discussed above. Further, woven fabric 800 may be formed by any suitable method for forming a woven fabric.

In such embodiments, the welds include areas in which the individual fibers, filaments or strands of the layer of base material 800 are fused or melted together. Fabric 800 may be subjected to a fusing or welding process. During a fusing or welding process, the individual fibers of fabric 800 may be fused where the welding device comes in contact with the material. The fused fibers may form weld 810. Weld 810 may be an area of fused fibers of a woven fabric.

Figure 2:
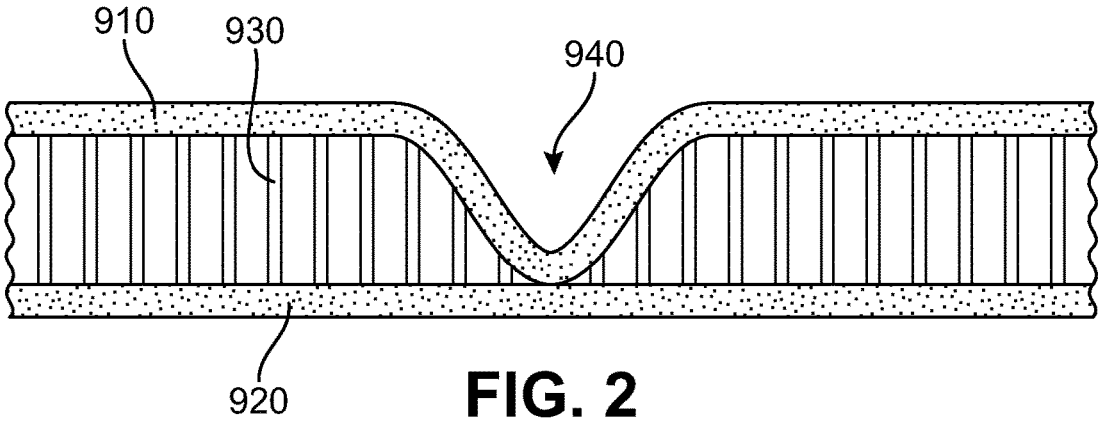
FIG. 2 is a schematic diagram of an embodiment of a multi-layer composite that has been welded.
Figure 3:
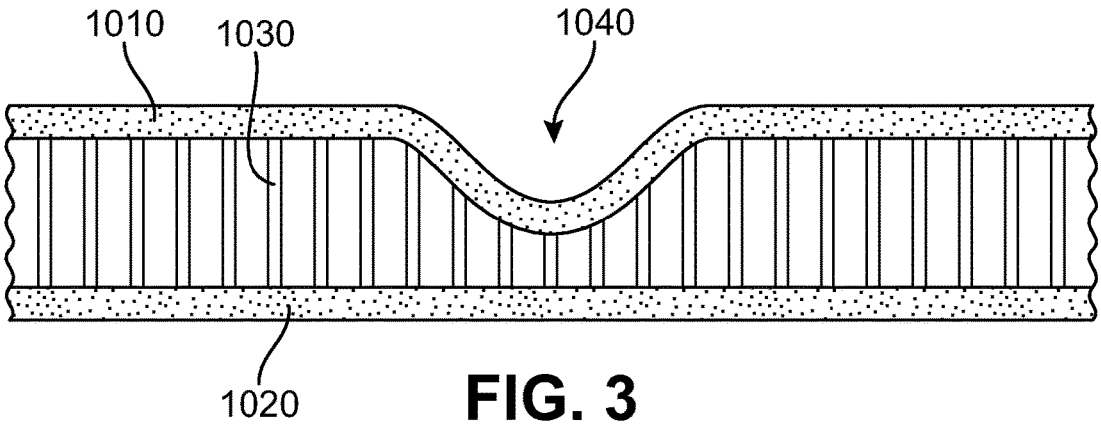
FIG. 3 is a schematic diagram of an embodiment of a multi-layer composite that has been welded.

In other embodiments, the base material of the shoe upper may include a multi-layer composite. FIGS. 2 and 3 depict a multi-layered composite. Further, FIGS. 2 and 3 depict welds that may be formed in a multi-layer composite. In some embodiments, the multi-layer composite may include a top layer and a bottom layer, where the top layer is connected to the bottom layer by interconnecting fibers. In other embodiments, the multi-layer composite may include two or more layers that are laminated one on top of each other. In further embodiments, the multi-layer composite may include a foam layer that may be positioned between a top layer and a bottom layer. Further, the top layer and bottom layer may be a fabric.

FIG. 2 depicts a multi-layer composite. The multi-layer composite may include a top layer 910, a bottom layer 920. Top layer 910 and bottom layer 920 may be connected by multiple interconnecting fibers 930 disposed between top layer 910 and bottom layer 920. In FIG. 2, the embodiment of the multi-layer composite may have been welded. In some embodiments, top layer 910 may be fused to bottom layer 920 at weld 940.

Similar to FIG. 2, FIG. 3 depicts a multi-layer composite. The multi-layer composite may include a top layer 1010, a bottom layer 1020 and multiple interconnecting fibers 1030 disposed between top layer 1010 and bottom layer 1020. In FIG. 2, the embodiment of the multi-layer composite may have been welded. In this embodiment, the composite may be welded wherein top layer 1010 may be indented toward bottom layer 1020 at weld 1040. Unlike FIG. 2, top layer 1010 may not be fused to bottom layer 1020. Rather, the material of top layer 1010 may be deformed toward bottom layer 1020. Further, top layer 1010 may be fused to interconnecting fiber 1030 at weld 1040 but may not be fused to bottom layer 1020.

Figure 4:
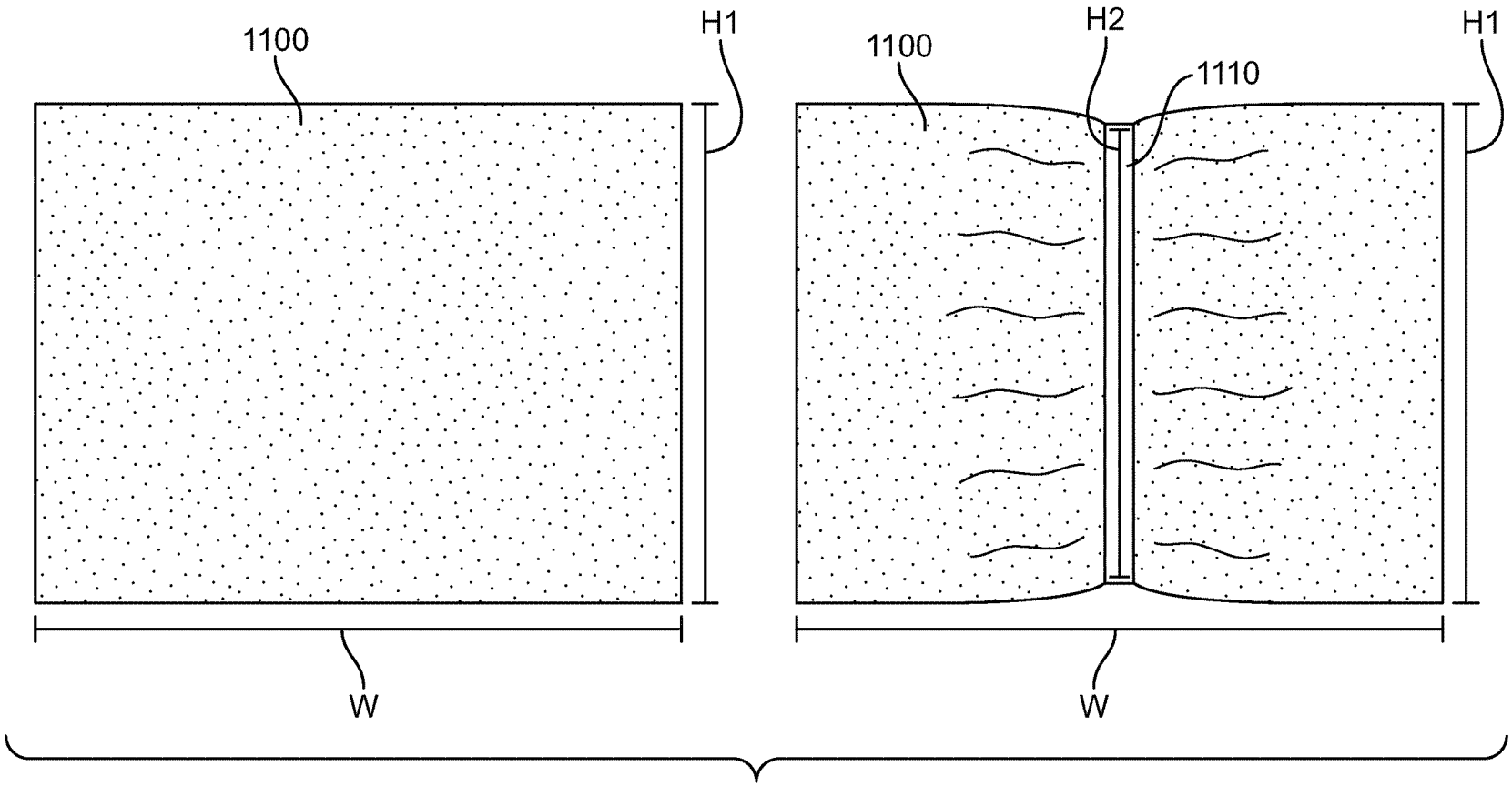
FIG. 4 is a schematic diagram of an embodiment of non-woven material that includes a welded portion.

In other embodiments, the base material may include a non-woven material. The non-woven material may include a non-woven fabric, polymeric sheet, leather or synthetic leather. FIG. 4 depicts an embodiment of non-woven material prior to being subjected to a welding process as well as an embodiment of the material after the weld is formed. In particular, FIG. 4 depicts a portion of non-woven material 1100. Prior to a welding process, the portion of non-woven material 1100 has width, W, and first height H1, as shown in the left illustration.

Subjecting the non-woven material may change the physical properties of non-woven material 1100. After a welding process, non-woven material 1100 may include weld 1110. Weld 1110 may be formed in the height direction. As shown in the illustration on the right, weld 1110 may have a second height H2. The length of second height H2 may be less than first height H1. This change in height occurs because the welding process may change the properties of the material where the material is shortened in a specific direction along the weld.

The welds of the upper may be formed by any suitable method of fusing materials of a shoe upper. In some embodiments, the base material of the upper may be fused by a thermal fusion method. The thermal fusion method may include bonding through hot die, steam or hot air heating methods. In other embodiments, the base material of the upper may be fused by a welding method.

In some embodiments, welding methods may be utilized to form welds in a shoe upper. The welding method utilized to create the welds may include a high frequency welding method. The high frequency welding method may include an ultrasonic welding method or a radio frequency welding method.

In those embodiments where a high frequency welding method is utilized to form the welds in the base material of the upper, the base material may be made of any material suitable for such a method. Further, the base material may be made of any material suitable for high frequency welding methods. Materials suitable for high frequency welding include thermoplastic material or natural material coated with a thermoplastic material. Examples of material suitable for high frequency welding methods include an acrylic, a nylon, a polyester, a polylactic acid, a polyethylene, a polypropylene, polyvinyl chloride (PVC), an urethane, a natural fiber, such as cotton or wool, that is coated with one or more thermoplastic materials, such as an ethyl vinyl acetate or thermoplastic polyurethane, and combinations thereof.

In some embodiments, an ultrasonic welding device is used to fuse portions of the base material. Ultrasonic welding devices utilize high frequency ultrasonic acoustic vibrations. The vibrations may be applied locally to a portion of the base material of the shoe upper. Further, the vibrations applied to the base material cause friction. The friction softens the base material to fuse the specific portion of the material. The fusion of the selected portions of the upper may be considered a solid state weld.

Some embodiments may employ one or more of the principles, concepts or methods disclosed in the following: Albanese et al., U.S. Pat. No. 7,883,594, entitled "Wrapped pile weatherstripping and methods of making same," issued on Feb. 8, 2011; Chernyak, U.S. Pat. No. 7,824,513, entitled "Apparatus and method for making pile articles and improved pile articles made therewith," issued on Nov. 2, 2010; Lehto et al., U.S. Pat. No. 7,776,171, entitled "Arrangement and method for treatment of a material by means of an ultrasonic device," issued on Aug. 17, 2010; Perrine, U.S. Pat. No. 6,835,257, entitled "Ultrasonic weld pattern for adsorbent containing package" issued on Dec. 28, 2004; and Collette et al., U.S. Pat. No. 5,713,399, entitled "Ultrasonic seaming of abutting strips for paper machine clothing" issued on Feb. 3, 1998; the entirety of each being hereby incorporated by reference.

Figure 5:
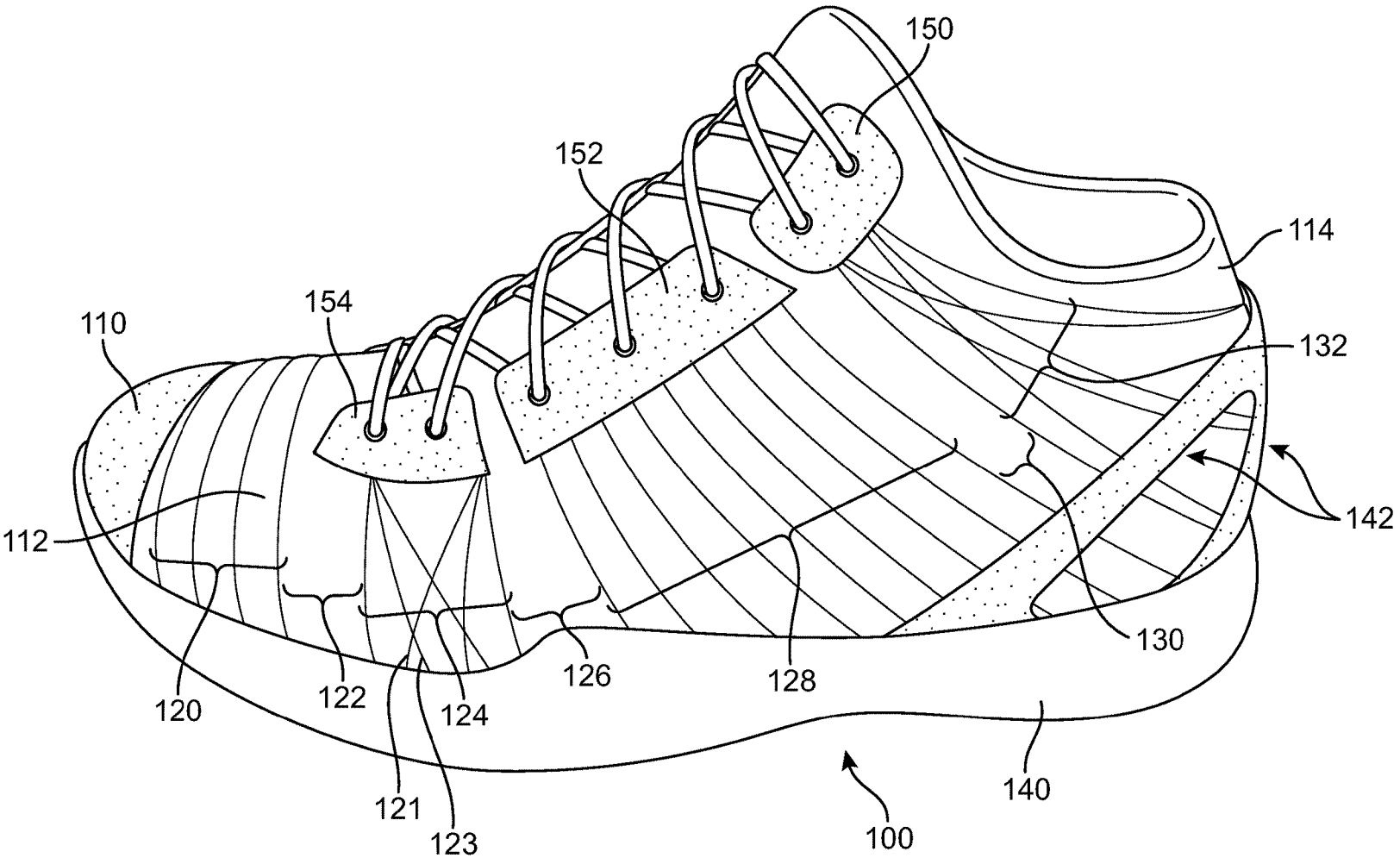
FIG. 5 is a schematic diagram of an embodiment of the lateral side of the shoe upper with selective welds.

FIG. 5 depicts an embodiment of the lateral side of shoe 100 having upper 114 that may include multiple welds. The multiple welds may be located in specific portions of upper 114. In some embodiment, upper 114 may include multiple locations or zones having multiple welds. Further, upper 114 may include multiple zones that remain unwelded.

More specifically, in the embodiment shown in FIG. 5, the lateral side of upper 114 may have multiple weld zones and multiple zones that may be unwelded. Further, the lateral side of upper 114 may include multiple eyelet portions. Each eyelet portion may include additional material that may be overlaid on the base material of the upper.

First weld zone 120 may be located in the toe box portion of shoe 100 spanning from the lateral side to the medial side of upper 114. Second weld zone 124 may be located along the lateral side between the first eyelet portion 154 and sole structure 140. Third weld zone 128 may be located along the lateral side between the second eyelet portion 152 and the sole structure 140. Fourth weld zone 132 may be located from the third eyelet portion 150 around the ankle of upper 114 to outer heel support 142.

Further, upper 114 may include unwelded zones on the lateral side of shoe 100. First unwelded zone 122 may be located in the toe box portion of upper 114 between first weld zone 120 and second weld zone 124. Second unwelded zone 126 may be located between second weld zone 124 and third weld zone 128. In addition, second unwelded zone 126 may continue between first eyelet portion 154 and second eyelet portion 152. Third unwelded zone 130 may be located between third weld zone 128 and fourth weld zone 132. Like second unwelded zone 126, third unwelded zone 132 may continue between second eyelet portion 152 and third eyelet portion 150.

Each weld zone may include any number of welds. The number of welds in each weld zone may depend on the amount of support and structure that is desired for that particular zone. In addition, the welds may be formed in each weld zone in any suitable pattern. In some cases, the amount of support and structure desired for each zone may determine the number of welds as well as the pattern of welds.

The weld or welds described above may be used to vary one or more properties of the upper. In some embodiments, the weld or welds may provide a base material that stretches less in any direction in that specific location. The weld or welds formed in the base material may restrain the base material from stretching in a lateral direction. The weld or welds formed in the base material may restrain the base material from stretching in a longitudinal direction. Further, the weld or welds formed in the base material may restrain the base material from stretching in both a lateral and longitudinal direction. In other words, the weld or welds formed in the base material provide similar support and structure to an upper that the inclusion of additional material in those same areas would if the additional material had been applied.

The weld or welds may also be used to reduce bending of the base material. In some embodiments, the weld or welds may increase the strength of the base material. In other embodiments, the weld or welds may increase the rigidity of the base material of the upper. Further, the weld or welds may reduce the flexibility of the base material of the upper in the weld zones.

In contrast, the unwelded flex zones of the upper may not restrain the base material from stretching or flexing. The unwelded flex zones are left unwelded in selected locations on the upper. The locations may be areas the shoe flexes during use. The upper of the shoe may flex in the same location and manner that the foot inside the shoe flexes. Therefore, the shoe upper of this disclosure not only may include welds formed in selected locations impart support and structure in those locations, but the shoe upper may include unwelded areas that also may be selectively located on the upper.

During activities that involve walking, running, or other ambulatory movements (e.g., cutting, braking), a foot within the shoes described above may tend to stretch the upper component of the shoe. That is, many of the material elements forming the upper (e.g., base material of the upper) may stretch when placed in tension by movements of the foot. Although the welds of the upper may also stretch, the welds generally stretch to a lesser degree than the other material elements forming the upper. The various welds of the upper may be located on the upper, therefore, to form structural components in the upper that (a) resist stretching in specific directions or locations, (b) limit excess movement of the foot relative to the sole structure and the upper, (c) ensure that the foot remains properly positioned relative to the sole structure and the upper, and/or (d) reinforce locations where forces are concentrated. In addition, the unwelded flex zones may be located on the upper to ensure that the upper of the shoe flexes in a substantially similar manner that the foot inside the shoe flexes.

For example, it may be desirable to have first weld zone 120 of the toe box portion of the upper or third weld zone 128 remain flexible in certain directions. First weld zone 120 and third weld zone 128 may be selected to remain flexible in the longitudinal direction (heel to toe direction) but less flexible in the lateral direction (instep to sole direction).

Each weld zone may include provisions for reducing the stretching of the base material. Further, each zone may include provisions for reducing the bending of the base material. In some embodiments, each zone may include provisions for increasing the strength of the base material. Still further, each zone may include provisions for increasing the rigidity of the base material of the upper. In other embodiments, each zone may include provisions for reducing the flexibility of the base material of the upper.

Generally, the welds of each weld zone may be oriented in any direction. In some embodiments, the welds may be located on the upper in a longitudinal, or lengthwise, direction. In other embodiments, the welds of a weld zone may be located in a lateral, or widthwise, direction. Further, the welds of a weld zone may be located in a diagonal direction, which is a direction between the longitudinal and lateral directions.

In some embodiments, the welds of a particular weld zone may not intersect. Further, the welds of a particular weld zone may be in the same direction. In other embodiments, two or more welds of a weld zone may intersect. Further, the welds of a weld zone may intersect more than one other weld. In some weld zones, some welds intersect while others do not. The degree of intersection may determine how much the stretch, bending, or flexibility of the material is reduced, and how much the strength and rigidity is increased.

Again, the welds may be located on the upper in any direction. The welds themselves may be formed in any shape. In some embodiments, the shape of the weld may be a solid line. In other embodiments, the shape of the weld may be a broken or dashed line. In further embodiments, the shape of the weld may be a wavy line. In still further embodiments, the shape of the weld may be a zigzag pattern. In addition, each weld of a weld zone may have a different weld pattern. Further still, each weld zone may include a different set of weld patterns.

As an example, in first weld zone 120 shown in FIG. 5, the series of welds are located radially across the toe of upper 114 from the lateral side to the medial side of the upper. In addition, third weld zone 128 may also include a series of welds that are located in substantially the same direction. In third weld zone 128, the welds may be located from second eyelet portion 152 to sole structure 140.

As another example, the second weld zone 124 between first eyelet portion 154 and sole structure 140 as well as fourth weld zone 132 in the ankle portion of the upper may be selected as an area that needs additional support. In other words, weld zones in which additional support is needed, such as second weld zone 124, may be selected to be less flexible. Further, such weld zones may be less stretchable. Still further, weld zones having added support may be less bendable. In addition, such weld zone may be stronger and/or more rigid in multiple directions. In order to achieve one or more of those characteristics, multiple welds may be formed in this zone. Further, the welds may be formed in multiple directions. In addition, some of the welds may intersect.

As can be seen in FIG. 5, the welds of second weld zone 124 and fourth weld zone 132 may not be formed in the same general direction. The welds of each zone may be formed in multiple directions. Further, the welds of each zone may intersect. The intersections may restrain the flexibility, stretch and/or bend of each zone in multiple directions. Further, the weld intersection may further increase the strength and rigidity of the weld zone. For example, the flexibility of second weld zone 124 and fourth weld zone 132 may be restricted in both the lateral and longitudinal directions. Again, the number of welds and the pattern of welds may depend on the degree of support and structure needed in each weld zone.

In addition to the weld zones and unwelded zones, the upper of shoe 100 may include additional material. The additional materials may be overlaid on base material 112 of upper 114. For example, upper 114 may include toe cap 110. Toe cap 110 may be formed from additional material. Toe cap 110 may span from the medial side to the lateral side of upper 114 in the toe box portion of upper 114. Further, toe cap 110 may be in contact with sole structure 140.

The additional materials may include any suitable material for a shoe upper. The suitable material may include woven textiles, nonwoven textiles, polymer sheet layers, plastics, rubbers, foam layers, leather, and synthetic leather. Further, the additional materials may include the same materials recited above as suitable for the base material. In some embodiments, the base material and the additional material may be different. In other embodiments, the base material and additional material may be the same.

Upper 114 of shoe 100 may further include heel support 142. Heel support 142 may be formed from additional material. The additional material may be overlaid on base material 112 of upper 114. Heel support 142 may span from the medial side to the lateral side of upper 114 wrapping around the heel of the upper. Further, heel support 142 may be in contact with sole structure 140.

Figure 6:
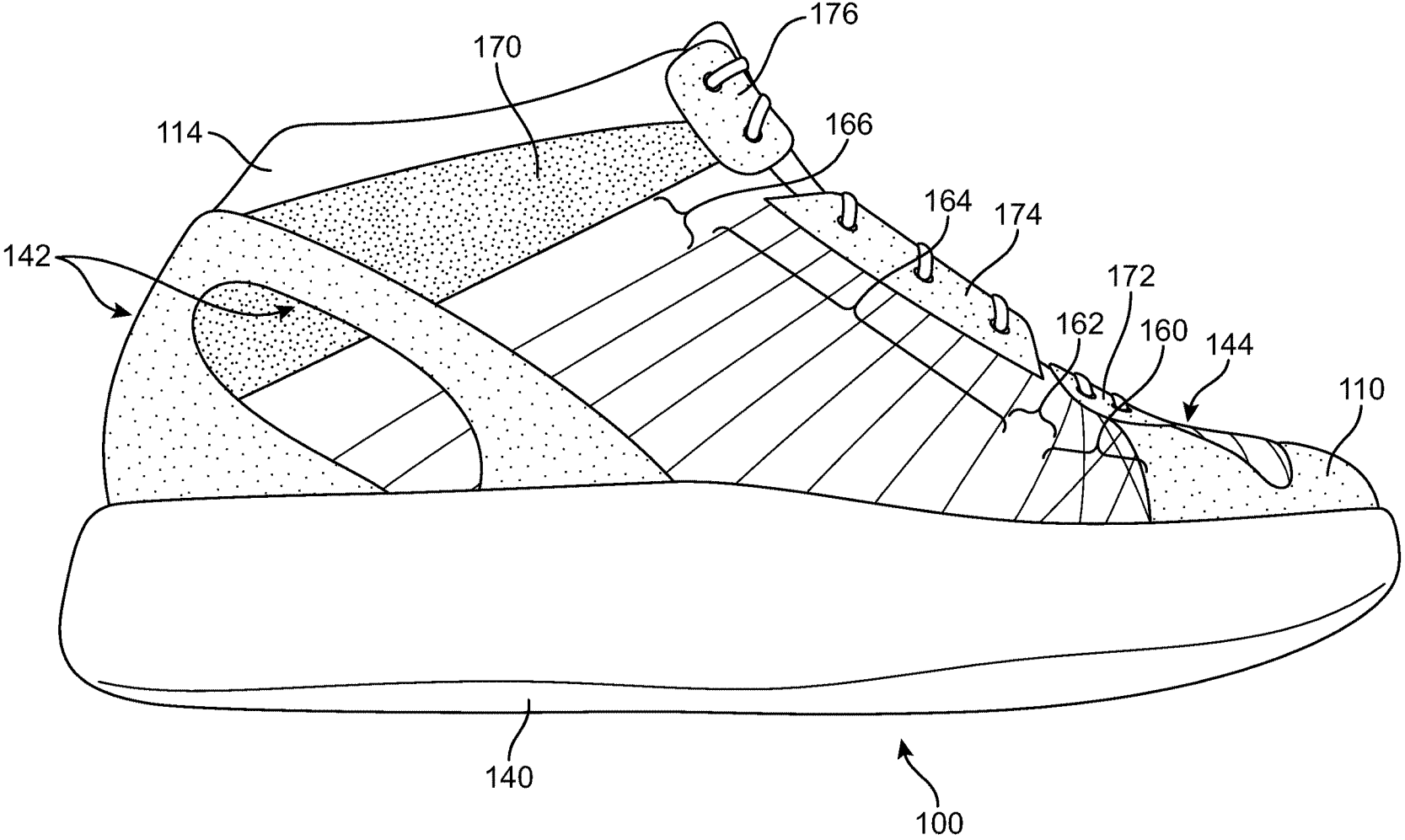
FIG. 6 is a schematic diagram of an embodiment of the medial side of the shoe upper with additional material and selective welds.

FIG. 6 depicts an embodiment of the medial side of shoe 100. Similar to the lateral side of upper 114 shown in FIG. 5, the medial side of upper 114 may have multiple weld zones. Further, the medial side also may include unwelded zones. Unlike the lateral side of upper 114, the medial side of upper 114 also may include additional material in certain locations.

More specifically, the medial side of upper 114 may include additional material in selected areas. As can be seen in FIG. 6, additional material may be added as toe strap 144 and ankle strap 170. Toe strap 144 may be an additional piece of material that may be located over or on top of base material 112 of upper 114. Toe strap 144 may be located between fourth eyelet portion 172 and sole structure 140. This additional material may provide support and structure in this selected area. The toe strap may provide additional support to the forefoot when a person moves while wearing shoe 100.

Similarly, ankle strap 170 may be an additional portion of material that may be located over or on top of base material 112 of upper 114. Ankle strap 170 may be located between sixth eyelet portion 176 and heel support 142. Again, the additional material may provide support and stability to the selected area. The ankle strap may provide additional ankle support when a person moves while wearing shoe 100.

In addition to added material included on the medial side of upper 114, as stated above, the medial side of upper 114 may include multiple weld zones. Fifth weld zone 160 may be located adjacent to toe strap 144. Fifth weld zone 160 may be located between the fourth eyelet portion 172 and sole structure 140. Similarly to second weld zone 124, fifth weld zone 160 may include multiple welds. The welds of fifth weld zone 160 may be formed in multiple directions. The welds of fifth weld zone 160 may intersect.

Further, the medial side of the upper may include sixth weld zone 164. Similar to third weld zone 128, sixth weld zone 164 may restrain flexibility or stretchability in certain directions. Sixth weld zone 164 may be selected to remain flexible in the longitudinal direction but the welds of the weld zone may restrain the flexibility or stretchability in the lateral direction. In such a case, sixth weld zone 164 may include a series of welds that may be substantially in the same direction. More specifically, in sixth weld zone 164, the welds may be formed from fifth eyelet portion 174 to sole structure 140.

The medial side of the embodiment shown in FIG. 6 also may include unwelded zones. Fourth unwelded zone 162 may be located between fifth weld zone 160 and sixth weld zone 164. In addition, fourth unwelded zone 162 may continue between fourth eyelet portion 172 and fifth eyelet portion 174. Fifth unwelded zone 166 may be located between second weld zone 164 and ankle strap 170. Fifth unwelded zone 166 may continue between fifth eyelet portion 174 and sixth eyelet portion 176.

Figure 7:
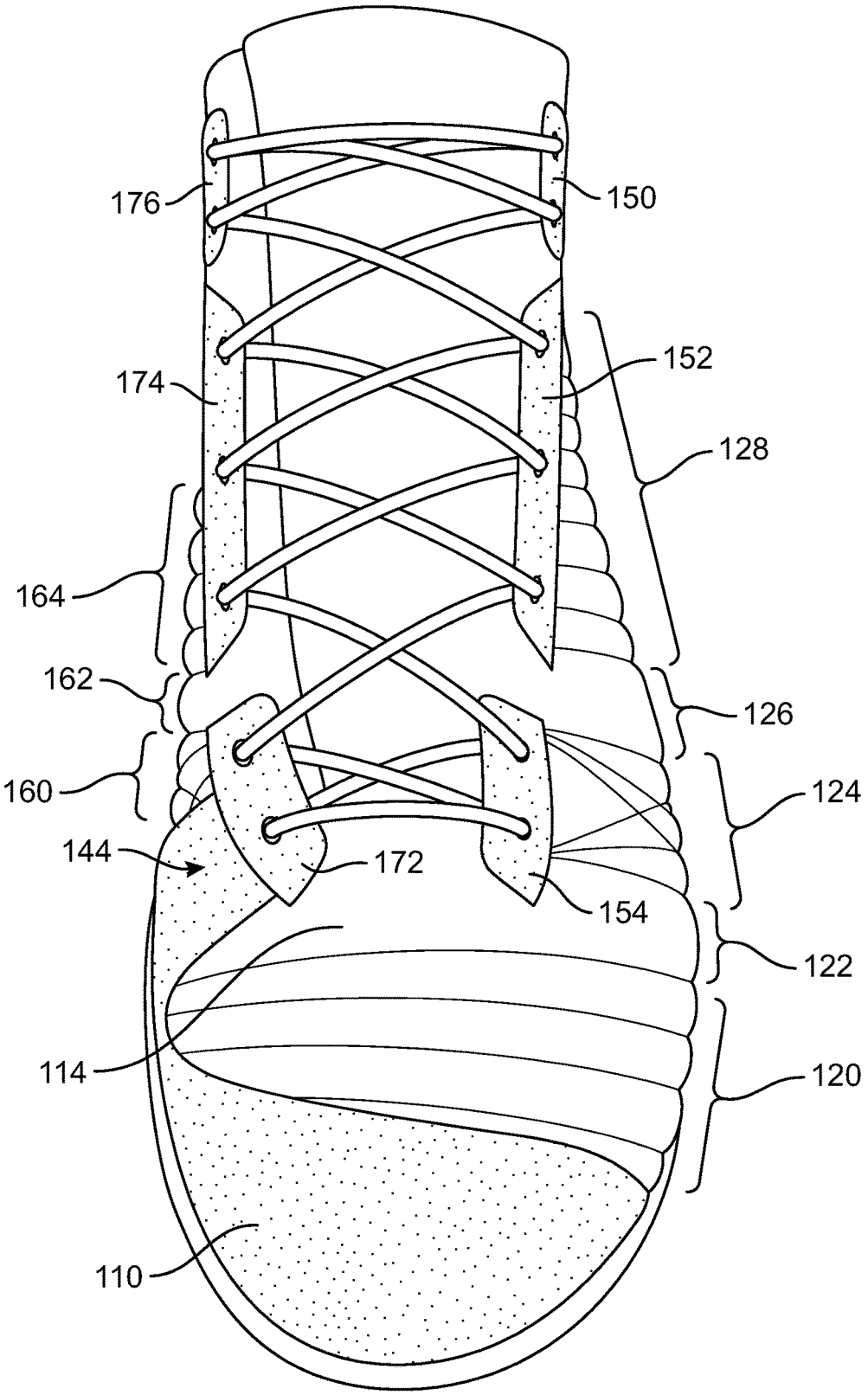
FIG. 7 is a schematic diagram of an embodiment of a shoe upper showing the toe and instep portion of the upper.

FIG. 7 depicts a top view of an embodiment of the toe portion and instep portion of shoe 100. FIG. 7 shows the multiple weld zones and unwelded zones of shoe 100 on both the medial side and the lateral side of the shoe. Further, toe strap 144 is shown on the medial side of upper 114. Toe strap 144 may span from sole structure 140 to fourth eyelet portion 172. Toe strap 144 may be affixed to the base material of the upper of shoe 100. In some embodiments, toe strap 144 may be affixed to the base material with stitching or an adhesive material. Toe strap 144 may help the foot to remain in the proper location within shoe 100 while a wearer is moving.

As can be seen in FIG. 7, the lateral side of shoe 100 lacks additional material in the approximately the same area. However, the lateral side of the shoe has second weld zone 124.

As described above, second weld zone 124 may include multiple welds. The welds of second weld zone 124 may also intersect. The series of welds in second weld zone 124 may provide the necessary support for this portion of upper 114. Second weld zone 124 may provide support for the wearer of shoe 100 in order for the wearer's foot to remain in the proper location within the shoe. In other words, second weld zone 124 may perform the same function on the lateral side of shoe 100 as toe strap 144 performs on the medial side of shoe 100. In some cases, second weld zone 124 may be characterized as an extension of toe strap 144. Forming a weld zone in place of a second toe strap on the lateral side of the shoe may lighten the shoe, decrease the cost of the shoe's materials, and reduce the complexity of the manufacturing process.

Figure 8:
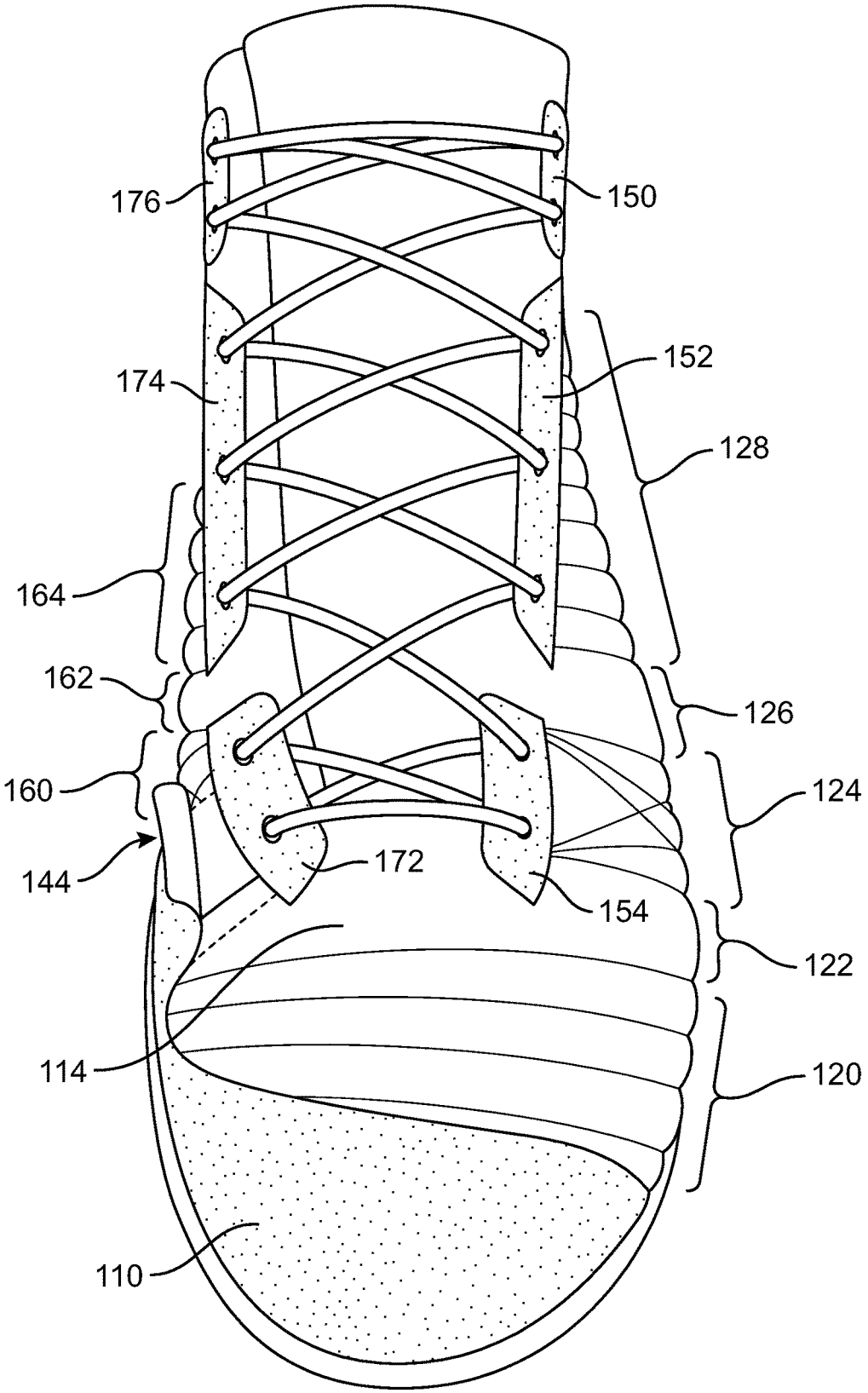
FIG. 8 is a schematic diagram of an embodiment of a shoe upper showing the toe and instep portion of the upper illustrating the additional material is overlaid on the base material of the shoe upper.

FIG. 8 depicts a similar embodiment as the embodiment illustrated in FIG. 7. Toe strap 144 is shown lifted and peeled back from the base material of the upper. In some embodiments, the base material under toe strap 144 may have no welds. In other embodiments, the base material under toe strap 144 may include one or more welds.

This depiction of toe strap 144 in FIG. 8 further illustrates upper 114 with additional material in selected locations. The additional material may provide structure and support to the selected location on upper 114. In addition, the additional material may increase the weight of the shoe. The additional materials may increase the overall costs of the shoe. Further, the additional material may increase the complexity of manufacturing the shoe by requiring stitching or an adhesive to attach the additional material to the base material of upper 114.

By reducing the amount of additional material added to the base material of a shoe upper, the weight of the shoe may be reduced. Further, reducing the amount of material needed for a shoe may reduce the costs of making the shoe. Still further, reducing the number of parts of a shoe may reduce the complexity of the manufacturing process. But in some embodiments, additional material may be used.

Figure 9:
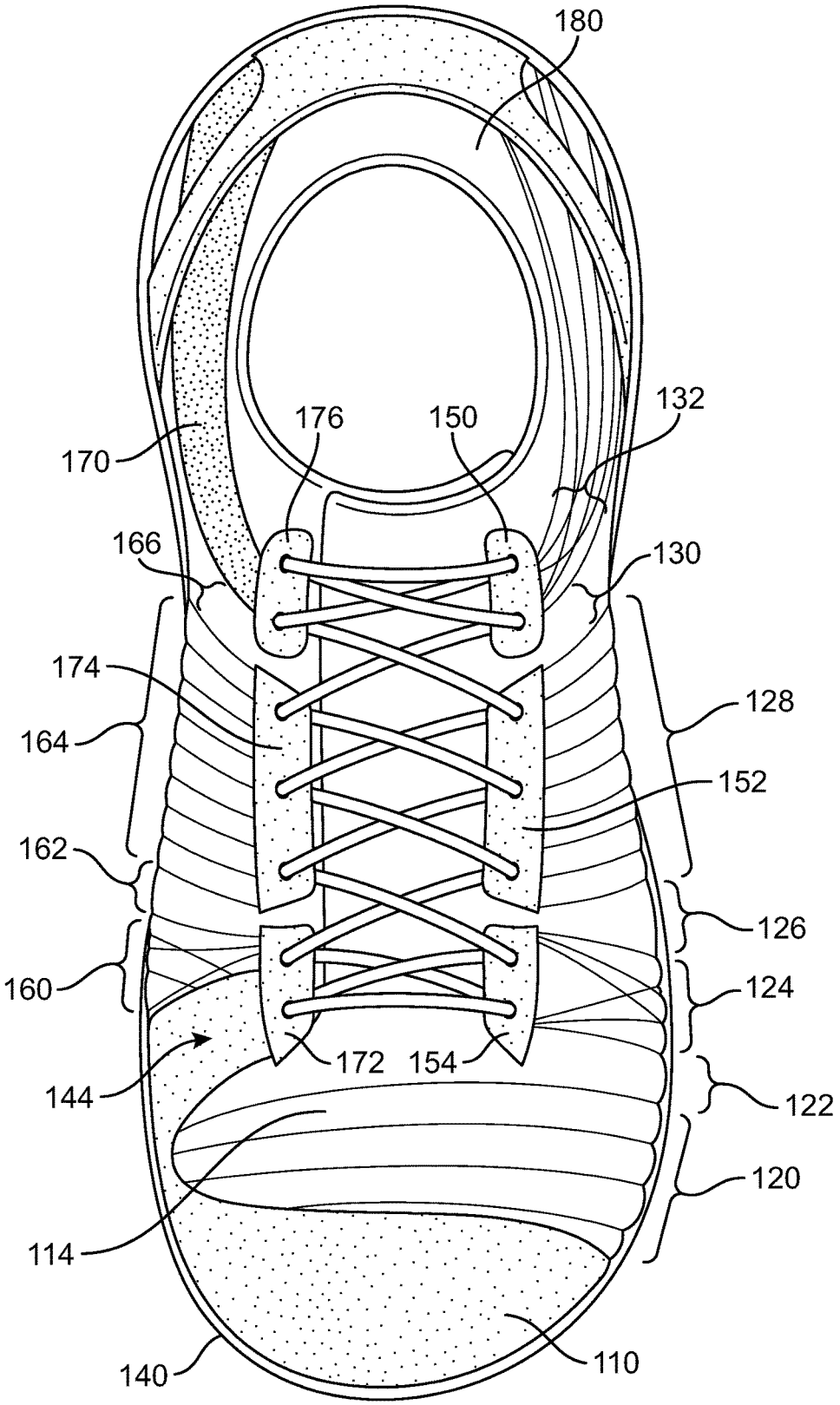
FIG. 9 is a schematic diagram of an embodiment of shoe upper, as viewed from above the shoe, showing the additional material on the medial side of the upper and the selective welding on the lateral side of the upper.

FIG. 9 depicts a top view of an embodiment of shoe 100. In particular, FIG. 9 illustrates the medial side and lateral side of ankle portion 180 of shoe 100. Similar to the toe strap depicted in FIG. 7, ankle portion 180 of shoe 100 has additional material on the medial side of upper 114 in the form of ankle strap 170. Ankle strap 170 may span from the heel portion of sole structure 140 to sixth eyelet portion 176. Ankle strap 170 may be affixed to base material 112 of upper 114 of shoe 100. In some embodiments, ankle strap 170 may be affixed to base material 112 with stitching or an adhesive material. Ankle strap 170 may provide support for the wearer of the shoe when he or she is moving while wearing the shoe in order for the foot to remain in the proper location within the shoe.

As can be seen in FIG. 9, the lateral side of the shoe may lack additional material in the approximately the same area as the medial side of ankle portion 180. However, the lateral side of the shoe may have fourth weld zone 132. As described above, fourth weld zone 132 may include multiple welds that intersect. The series of welds in fourth weld zone 132 may provide the necessary support for this portion of upper 114. Fourth weld zone 132 may provide support for the wearer of the shoe in order for the wearer's foot to remain in the proper location within the shoe. In other words, fourth weld zone 132 may perform the same function on the lateral side of the shoe as ankle strap 170 performs on the medial side of the shoe. Forming a weld zone in place of a second ankle strap on the lateral side of the shoe may lighten the shoe, decrease the cost of the shoe's materials, and reduce the complexity of the manufacturing process.

Figure 10:
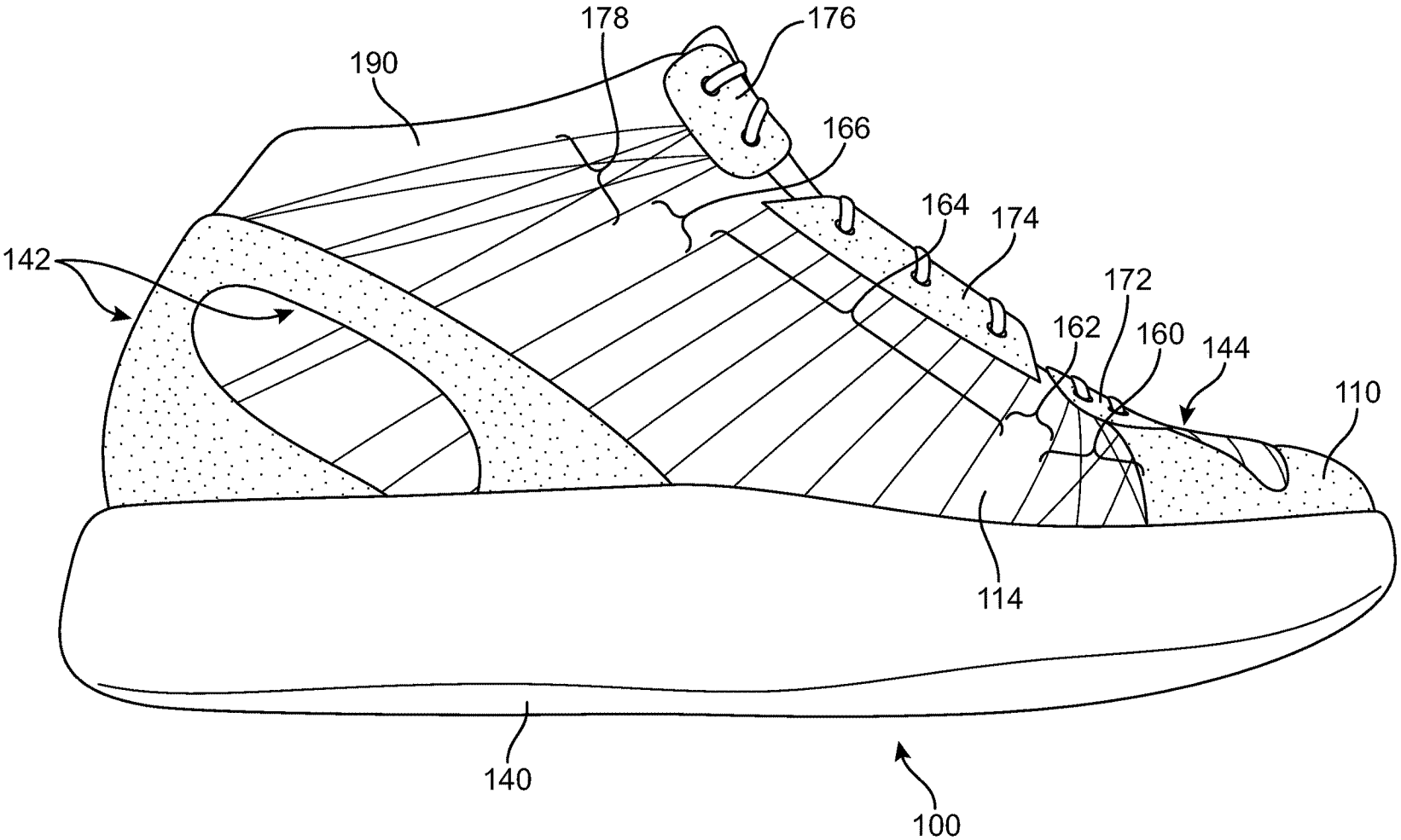
FIG. 10 is a schematic diagram of an embodiment of the medial side of the shoe upper with additional welds.

FIG. 10 shows another embodiment of the medial side of the shoe upper. This embodiment is similar to the embodiment shown in FIG. 6. However, ankle strap 170 shown in FIG. 2 may be replaced with seventh weld zone 178 of the embodiment shown in FIG. 10.

For purposes of this embodiment, the lateral side of shoe of FIG. 10 will be substantially the same as depicted in FIG. 5. The medial side of the shoe in FIG. 10 may include additional material. The additional material may be added to the base material in the form of a toe strap 144. Toe strap 144 may be an additional piece of material that may be located over or on top of the shoe upper base material. This additional material may provide support and stability this selected area. The toe strap may provide additional support when a person wearing shoe 100 moves or stops suddenly. The toe strap may further assist the wearer's foot to remain in the proper location inside the shoe.

In addition to the added material included on the medial side of upper 114, as stated above, the medial side of the upper may include multiple weld zones. Fifth weld zone 160 may be located adjacent to toe strap 144. Fifth weld zone 160 may be located between the fourth eyelet portion 172 and sole structure 140. Further, fifth weld zone 160 may include multiple welds. In some embodiment, the welds of fifth weld zone 160 may be formed in multiple directions. In some embodiments, the welds of fifth weld zone 160 may intersect.

Further, the medial side of upper 114 may include sixth weld zone 164. Sixth weld zone 164 may remain flexible or stretchable in certain directions. Sixth weld zone 164 may be selected to remain flexible in the longitudinal direction but the welds may restrain the flexibility or stretchability in the lateral direction. In such a case, sixth weld zone 164 may include a series of welds that may be substantially in the same direction. More specifically, in sixth weld zone 164, the welds are formed from fifth eyelet portion 174 to sole structure 140.

The medial side of the embodiment shown in FIG. 10 also may include seventh weld zone 178. Seventh weld zone 178 may be similar to fourth weld zone 132 shown in FIG. 5. The welds of seventh weld zone 178 may not be formed in the same general direction. The welds of seventh weld zone 178 may be formed in multiple directions. Further, the welds of seventh weld zone 178 may intersect. The intersections may restrain the flexibility or stretchability of the weld zone in multiple directions. For example, the flexibility or stretchability of seventh weld zone 178 may be restrained in both the lateral and longitudinal directions. Again, the number of welds and the pattern of welds in seventh weld zone 178 may depend on the degree of support and structure needed in each weld zone.

Figure 11:
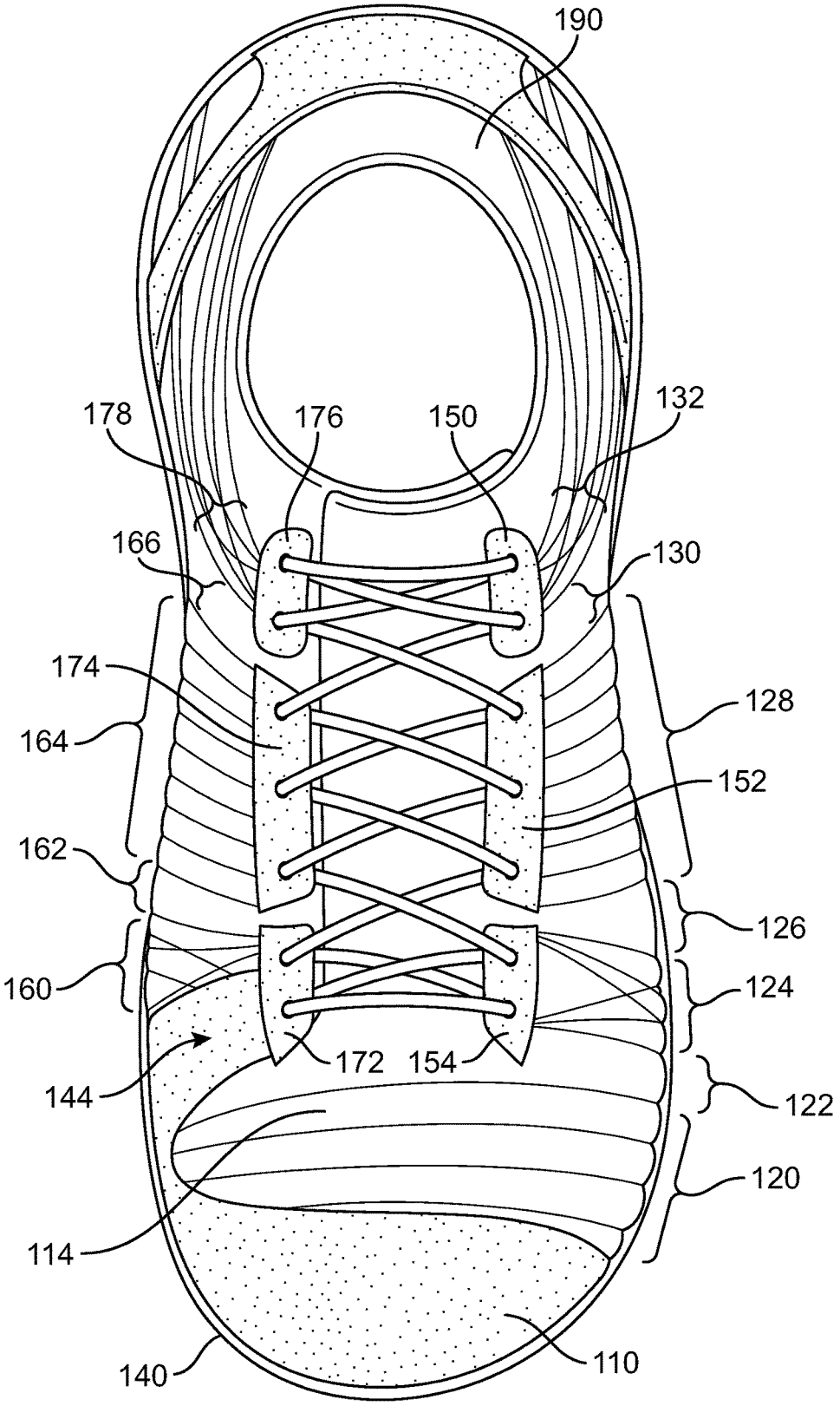
FIG. 11 is a schematic diagram of an embodiment of shoe upper, as viewed from above the shoe, showing the additional material and welds on the medial side of the upper and the selective welding on the lateral side of the upper.

FIG. 11 depicts a top view of an embodiment of shoe 100. In particular, FIG. 11 illustrates the medial side and lateral side of ankle portion 190 of shoe 100. Unlike the embodiment shown in FIG. 9, ankle portion 190 of shoe 100 has no ankle strap or additional material on the medial side of upper 114. In place of ankle strap 170 shown in FIG. 9, shoe 100 of FIG. 11 may include seventh weld zone 178. Seventh weld zone 178 may span from the heel portion of sole 140 to sixth eyelet portion 176. Seventh weld zone 178 may provide support for the wearer of the shoe when he or she cuts or stops suddenly in order for the foot to remain in the proper location within the shoe.

As can be seen in FIG. 11, both the lateral side and medial side of the shoe may lack additional material around the ankle. More specifically, the lateral side of the shoe may have fourth weld zone 132. Further, the medial side of the shoe may have seventh weld zone 178. As described above, fourth weld zone 132 and seventh weld zone 178 may include multiple welds that intersect.

The series of welds in fourth weld zone 132 and seventh weld zone 178 may provide the necessary support for this portion of upper 114. Fourth weld zone 132 and seventh weld zone 178 may provide support for the wearer of shoe 100 in order for the wearer's foot to remain in the proper position within the shoe. In other words, fourth weld zone 132 and seventh weld zone 178 may perform the same function as an ankle strap 170 performs, if included on the shoe. Forming a weld zone in place of an ankle strap on the lateral side and medial side of the shoe may lighten the shoe, decrease the cost of the shoe's materials, and reduce the complexity of the manufacturing process.

Figure 12:
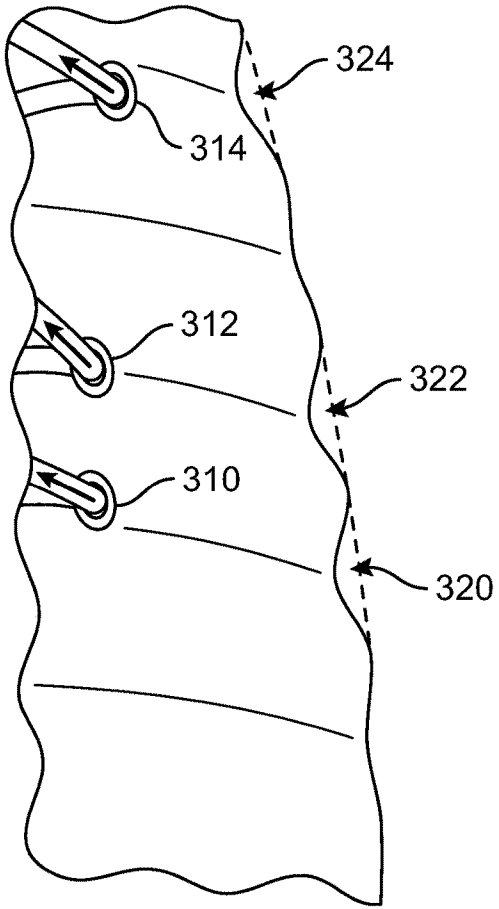
FIG. 12 is a schematic diagram of an embodiment of a portion of a shoe upper without welds.

The concept of a weld zone of the upper functioning as a virtual strap is further illustrated in FIGS. 12-15. FIG. 12 depicts a portion of the lateral side of a typical shoe. The portion of the shoe shown in FIG. 12 may have no welds or few welds. When the laces of the shoe are tightened through first eyelet 310, second eyelet 312 and third eyelet 314, the stress of the tightened laces on the eyelets results in the eyelets being pulled. As the eyelets are being pulled by the tightening laces, the material of the upper is also being pulled, or put under stress.

As can be seen, as the laces are tightened through first eyelet 310 and second eyelet 312, the material of the upper may also be pulled in line with the eyelets. More specifically, when the laces are tightened through first eyelet 310, the material adjacent to first eyelet 310 may also be pulled. The material may be pulled in substantially the same direction as first eyelet 310. The stress or pulling on the material causes first stress point 320. Further, when tension is placed on second eyelet 312, the material adjacent to second eyelet 312 may also be pulled in the same direction causing second stress point 322. Still further, when tension is placed on third eyelet 314, the material adjacent to third eyelet 314 may also be pulled in the same direction causing third stress point 324.

The stress points of a typical shoe may provide for a shoe that is less comfortable. In addition, the shoe may not provide the requisite support needed in a certain location on the upper. Without the requisite support, the foot may not remain properly positioned relative to the sole structure and the upper. Further, without support, the foot may move excessively relative to the sole structure and upper.

Figure 13:
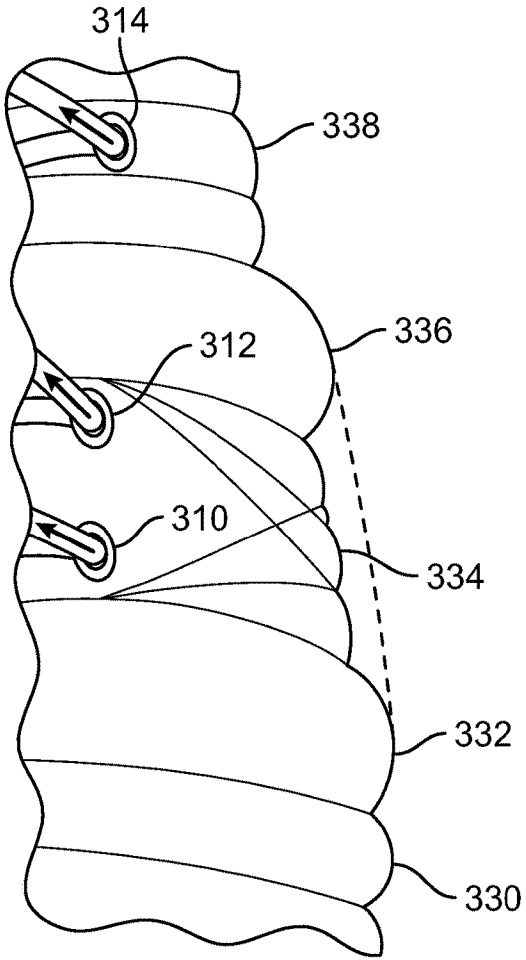
FIG. 13 is a schematic diagram of an embodiment of a portion of a shoe upper having welds zones.

In contrast, a portion of an embodiment of the lateral side of a shoe of the disclosure is shown in FIG. 13. The portion of the shoe upper shown in FIG. 13 may include welded zones and unwelded zones. More specifically, the upper may include first weld zone 330, second weld zones 334 and third weld zone 338. In addition, the upper may include first unwelded zone 332 and second unwelded zone 336. Further, the portion of the upper shown in FIG. 13 may include first eyelet 310, second eyelet 312 and third eyelet 314.

Similar to FIG. 12, when the laces are tightened through the eyelets, the material of the upper is also tightened or pulled, as shown in FIG. 13. The material may be pulled in the same direction as the eyelets. However, unlike FIG. 12, the weld zones of FIG. 13 may spread the stress placed on the upper throughout the weld zone. More specifically, when the laces are tightened through first eyelet 310 and second eyelet 312, the material of second weld zone 334 is also pulled or placed under tension. As can be seen, the entire weld zone is pulled in the same direction the eyelets are being pulled. Instead of two stress points (shown in FIG. 12), the stress is dissipated through the weld zone. In other words, the stress placed on the weld zone is similar to the stress placed on a strap, if a strap were disposed in the same position as the weld zone. With this arrangement, the weld zones of the upper shown in FIG. 13 may function as virtual straps.

Further, the weld zone may be located on this portion of the upper to form structural components in the upper that (a) resist stretching in specific directions or locations, (b) limit excess movement of the foot relative to the sole structure and the upper, (c) ensure that the foot remains properly positioned relative to the sole structure and the upper, and/or (d) reinforce locations where forces are concentrated.

Figure 15:
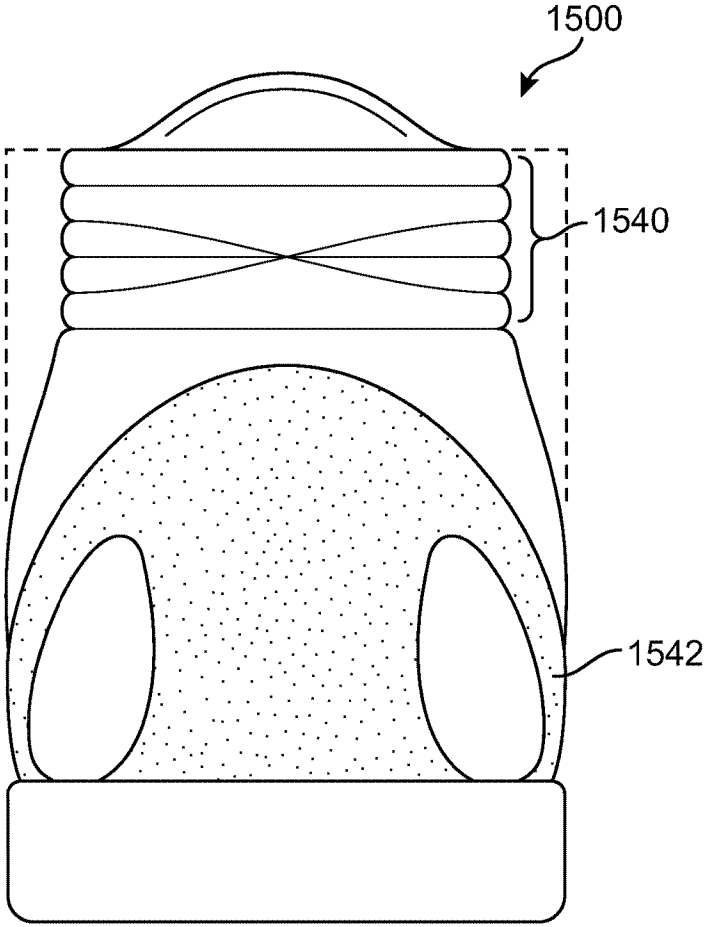
FIG. 15 is a schematic diagram of an embodiment of a shoe upper having welds zones viewed from the rear.
Figure 14:
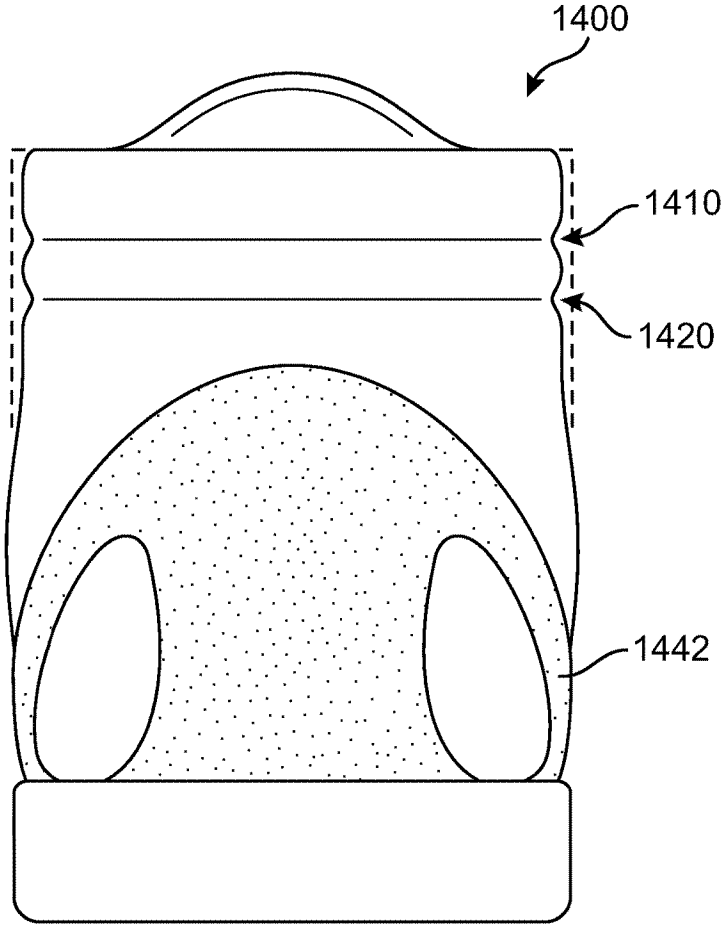
FIG. 14 is a schematic diagram of an embodiment of a shoe upper without welds viewed from the rear.

FIGS. 14 and 15 also illustrate the concept of a weld zone functioning as a virtual strap in a particular area of a shoe. More specifically, a weld zone around the ankle portion of a shoe may function as a strap would in the same position. FIG. 14 depicts a rear view of typical shoe 1400. The shoe depicted in FIG. 14 may contain no welds or few welds. As the laces of a shoe are tighten around the ankle portion of the shoe upper, the eyelets are pulled in the direction of the tightened laces. The stress placed on the eyelets results in the material of the upper being pulled in the substantially same direction as the eyelets.

As shown in FIG. 14, the tightening of the laces, and pulling of the eyelets results in stress points around the ankle. Stress point 1410 may be the result of the tightening of the laces through the top corresponding eyelets on the instep of the shoe. Stress point 1420 may be the result of the laces being tightened through a second set of corresponding eyelets below the top eyelets. The material in the ankle portion of the shoe may be pulled as the laces and eyelets are pulled.

The result of no welds or straps may be a less comfortable shoe around the ankle. In addition, the material around the ankle may not be tightened to sufficiently provide support to the wearer of the shoe. Without the requisite support, the foot may not remain properly positioned relative to the sole structure and the upper. Further, without support, the foot may move excessively relative to the sole structure and upper.

In contrast, FIG. 15 depicts shoe 1500 that may include weld zone 1540 around the ankle portion of the upper. Weld zone 1540 may include multiple welds within the zone. The welds of weld zone 1540 may intersect. The welds of weld zone 1540 may span from the lateral side of the upper to the medial side of the upper around the back of the ankle portion of the upper.

As the laces are tightened through eyelets in the shoe upper, the ankle portion of the upper is pulled or tightened. In contrast to FIG. 14, when the laces are tightened in the ankle portion of the upper, weld zone 1540 may tighten around the ankle of the wearer of the shoe. As can be seen in FIG. 15, weld zone 1540 as a whole tightens. Further, the ankle portion of shoe 1500 in FIG. 15 that includes weld zone 1540 may not have any stress points. Rather, the welds of the weld zone may be pulled along with the eyelets. As the welds of the weld zone tighten, the weld zone as a whole tightens. In other words, the weld zone functions as a strap would function in the same position. However, the weld zones require no additional material to provide the function of a strap. Therefore, weld zones may provide for a shoe that has less material. In turn, a shoe with less material may be a lighter shoe.

In addition, because the weld zone tightens as a whole, the ankle portion is able to tighten around the ankle of the user to provide better support than a typical shoe. In addition, a shoe with weld zones may retain the same function as would an upper that includes additional material as straps. Therefore, the weld zones may provide for a lighter shoe that also provides the necessary support in the designated portions of the upper.

The weld zone may be located on this portion of the upper, therefore, to form structural components in the upper that (a) resist stretching in specific directions or locations, (b) limit excess movement of the foot relative to the sole structure and the upper, (c) ensure that the foot remains properly positioned relative to the sole structure and the upper, and/or (d) reinforce locations where forces are concentrated.

Based upon the above discussion, the upper portion of the shoe of this disclosure having multiple weld zones may have various configurations. Although each of these configurations are discussed separately, many of the concepts presented above may be combined to impart specific properties or otherwise ensure that upper having multiple weld zones may be optimized for a particular purpose or product.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A shoe upper, the shoe upper including a base material comprising:

a lateral side having multiple weld zones, multiple unwelded zones, and multiple eyelet portions overlaid on the base material; and a medial side having multiple weld zones, multiple unwelded zones, multiple eyelet portions overlaid on the base material, a toe strap overlaid on the base material, and an ankle strap overlaid on the base material;

wherein each of the multiple weld zones comprises a plurality of welds;

wherein a first weld zone of the multiple weld zones is located in a toe box portion of the shoe upper;

the first weld zone includes at least two welds of the plurality of welds that extend radially across the top of the toe box portion of the shoe upper from the lateral side to the medial side of the shoe upper spanning across a lateral direction of the shoe upper; and wherein a second weld zone of the multiple weld zones includes at least two welds of the plurality of welds that cross each other at an intersection disposed within the second weld zone.

2. The shoe upper according to claim 1, wherein the lateral side of the shoe upper further includes the first weld zone, the second weld zone, a third weld zone, and a fourth weld zone.

3. The shoe upper according to claim 1, wherein the second weld zone is aligned in the lateral direction with the toe strap on the opposite medial side so as to be characterized as an extension of the toe strap.

4. The shoe upper according to claim 2, wherein the second weld zone is located below a first eyelet portion and between a first unwelded zone and a second unwelded zone; and wherein the second weld zone includes multiple welds that are oriented in different directions from each other.

5. The shoe upper according to claim 1, wherein the at least two welds of the plurality of welds of the first weld zone extend radially over the toe box portion of the shoe upper.

6. The shoe upper according to claim 2, wherein the third weld zone is located below a second eyelet portion and between the second unwelded zone and a third unwelded zone; and wherein third weld zone includes multiple welds that are oriented in substantially the same direction to each other.

7. The shoe upper according to claim 2, wherein the fourth weld zone is located between a third eyelet portion and an outer heel support; and wherein the fourth weld zone includes multiple welds that are oriented along different directions from each other.

8. The shoe upper according to claim 4, wherein at least two of the welds of the fourth weld zone intersect.

9. The shoe upper according to claim 1, wherein the medial side of the shoe upper further includes a fifth weld zone and a sixth weld zone.

10. The shoe upper according to claim 9, wherein the fifth weld zone is located below a fourth eyelet portion and between and adjacent to the toe strap;

wherein the second weld zone includes multiple welds that are oriented along different directions from each other; and wherein at least two of the welds of the fifth weld zone intersect.

11. The shoe upper according to claim 4, sixth weld zone is located below a fifth eyelet portion and between a fourth unwelded zone and a fifth unwelded zone; and wherein sixth weld zone includes multiple welds that are oriented in substantially the same direction to each other.

12. A shoe, comprising:

an upper and a sole structure, the upper including a base material;

wherein a lateral side of the upper comprises multiple weld zones, multiple unwelded zones, and multiple eyelet portions overlaid on the base material;

wherein a medial side of the upper comprises multiple weld zones, multiple unwelded zones, multiple eyelet portions overlaid on the base material, a toe strap overlaid on the base material, and an ankle strap overlaid on the base material;

wherein each of the multiple weld zones comprises a plurality of welds;

wherein a first weld zone of the multiple weld zones is located in a toe box portion of the shoe upper;

the first weld zone includes at least two welds of the plurality of welds that extend radially across the top of the toe box portion of the shoe upper from the lateral side to the medial side of the shoe upper spanning across a lateral direction of the shoe upper; and wherein a second weld zone of the multiple weld zones includes at least two welds of the plurality of welds that cross each other at an intersection disposed within the second weld zone.

13. The shoe according to claim 12, wherein the second weld zone is located on the lateral side of the shoe; and wherein the second weld zone is located between a first eyelet portion and the sole structure.

14. The shoe according to claim 13, where the toe strap is located on the medial side of the upper opposite the second weld zone on the lateral side.

15. The shoe according to claim 13, where a third weld zone is located on the lateral side of the shoe, the third weld zone includes at least two welds of the plurality of welds that cross each other at an intersection; and wherein the third weld zone is located between a second eyelet portion and an outer heel support around an ankle portion of the upper.

16. The shoe according to claim 15, where the ankle strap is located on the medial side of the upper opposite the third weld zone on the lateral side.

17. A shoe, comprising:

an upper and a sole structure;

the upper including a base material;

wherein a lateral side of the upper comprises multiple weld zones having multiple welds, multiple unwelded zones, and multiple eyelet portions overlaid on the base material;

wherein a medial side of the upper comprises multiple weld zones having multiple welds, multiple unwelded zones, and multiple eyelet portions overlaid on the base material;

wherein each of the multiple weld zones comprises a plurality of welds;

wherein a first weld zone of the multiple weld zones is located in a toe box portion of the shoe upper;

the first weld zone includes at least two welds of the plurality of welds that extend radially across the top of the toe box portion of the shoe upper from the lateral side to the medial side of the shoe upper spanning across a lateral direction of the shoe upper; and wherein a second weld zone of the multiple weld zones includes at least two welds of the plurality of welds that cross each other at an intersection disposed within the second weld zone.

18. The shoe according to claim 17, wherein the second weld zone having intersecting welds is located on the lateral side of the upper from below a first eyelet portion and wrapping around an ankle portion of the upper to an outer heel support; and wherein a third weld zone having intersecting welds is located on the medial side of the upper from a second eyelet portion and wrapping around the ankle portion of the upper to the outer heel support.

19. The shoe according to claim 18 wherein a fourth weld zone having intersecting welds is located from below a third eyelet portion and spanning to the sole structure where an instep of the upper meets the toe box portion of the upper; and wherein a toe strap is located on the medial side of the upper opposite the fourth weld zone.

20. The shoe according to claim 19, wherein the second weld zone and the third weld zone around the ankle portion of the upper reduces the stretch of the base material in both a lateral direction and a longitudinal direction of the upper.

* * * * *